United States Patent [19]

Hanaoka et al.

[11] 4,383,505

[45] May 17, 1983

[54] DEVICE FOR PREVENTING CHANGE OF FIXED ANGLE OF DISTRIBUTOR

[76] Inventors: Masanori Hanaoka, 1119-63, Kamiike-cho 1-chome, Toyota-shi, Aichi-ken; Takakazu Kawabata, 21-144, Akiba-cho 8-chome, Toyota-shi, Aichi-ken; Tetsuo Kondo, 133-2, Takigawa-cho, Showa-ku, Nagoya-shi, Aichi-ken, all of Japan

[21] Appl. No.: 269,597

[22] Filed: Jun. 2, 1981

[30] Foreign Application Priority Data

Jan. 16, 1981 [JP] Japan ..... 56-5807

[51] Int. Cl.[3] ..... F02P 7/02

[52] U.S. Cl. ..... 123/146.5 A; 200/19 DC; 24/255 R; 248/503; 403/373

[58] Field of Search ..... 123/146.5 A; 200/190 R, 200/22, 25, 29; 24/255 R, 256, 257; 248/503; 403/373, 378

[56] References Cited

U.S. PATENT DOCUMENTS

| | | | |
|---|---|---|---|
| B 536,724 | 1/1975 | Julian et al. | 123/146.5 A |
| 1,018,137 | 2/1912 | Smith | 123/146.5 A |
| 3,397,683 | 8/1968 | Phillips | 123/146.5 A |
| 3,861,225 | 1/1975 | Mattson | 123/146.5 A |
| 4,040,407 | 8/1977 | Heine | 123/146.5 A |
| 4,186,709 | 2/1980 | Bolles | 123/146.5 A |
| 4,285,306 | 3/1981 | Fox et al. | 123/146.5 A |

FOREIGN PATENT DOCUMENTS

| | | | |
|---|---|---|---|
| 80023 | of 0000 | Austria | 123/146.5 A |
| 405529 | 8/1943 | Italy | 123/146.5 A |
| 54-152722 | 12/1979 | Japan | 123/146.5 A |

OTHER PUBLICATIONS

Research Disclosure, Sep. 1978, USA-123-146-5A, #17316 Tamper Proof Distributor Installation, pp. 30-31.

*Primary Examiner*—Raymond A. Nelli

*Attorney, Agent, or Firm*—Stevens, Davis, Miller & Mosher

[57] ABSTRACT

A device for preventing a fixed angle change of a distributor in relation to an engine. The distributor includes a cylindrical portion, through which a rotor shaft is pierced, and a flange formed on the cylindrical portion. The cylindrical portion is rotatably fitted into a fitting hole formed in the engine while the flange is seated on the engine. A fixing block of substantially hexahedron shape having at least one thrusting projection on either side surface is forcedly inserted into an arcuate elongated hole formed in the flange by means of fastening a bolt pierced through a circular hole formed in the fixing block. The thrusting projections intrude into side walls of the elongated hole for preventing movement of the flange in relation to the fixing block which is firmly fixed to the engine by the bolt.

10 Claims, 11 Drawing Figures

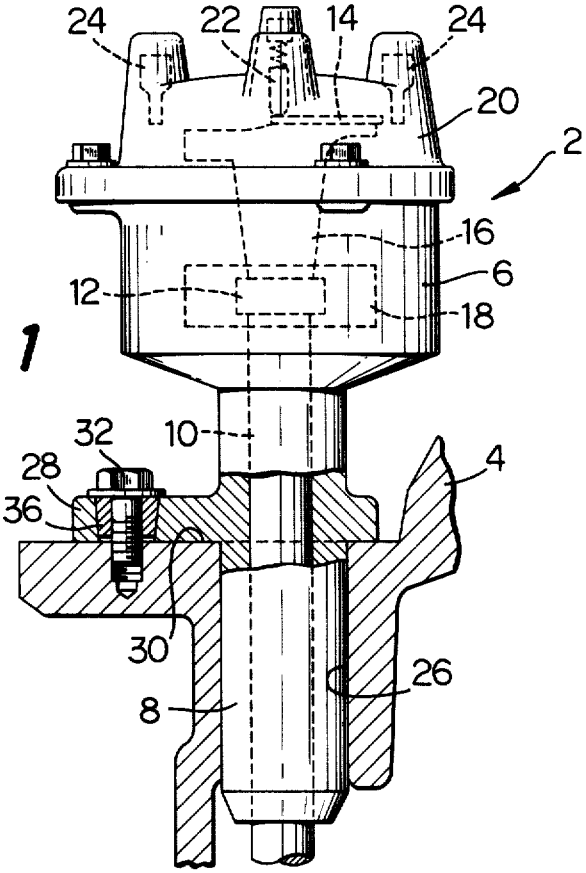
FIG. 1
FIG. 5
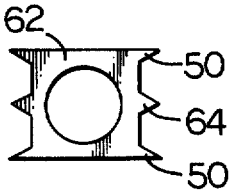
FIG. 7
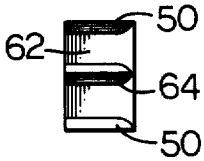
FIG. 8
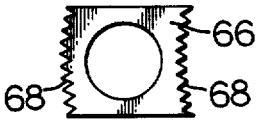
FIG. 6
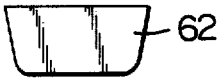
FIG. 10
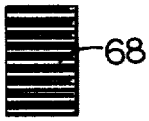
FIG. 9
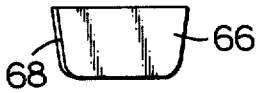

DEVICE FOR PREVENTING CHANGE OF FIXED ANGLE OF DISTRIBUTOR

FIELD OF THE INVENTION

This invention relates to a distributor for supplying ignition voltage to an engine, and more particularly to a preventive device for a distributor which does not allow the distributor, after having once been position-settled with a certain angle upon adjustment of the ignition timing, to be easily changed in its fixed angle.

BACKGROUND OF THE INVENTION

A distributor is an apparatus, which includes a rotor and ignition signal generating means consisting of a pick-up, a chopper, etc., for generating ignition signal in response to rotation of the rotor, for supplying ignition voltage to each of the plugs at a best timing. For that purpose the rotor is usually rotated by a cam-shaft or the like synchronously with the rotation of the engine, and the timing of ignition is therefore determined by means of adjusting the phase of the ignition signal generating means against the rotor.

As a concrete way of adjusting the phase of the ignition signal generating means against the rotor it has been recognized to be practicable to make the whole of a distributor housing rotate in relation to the rotor. For that reason it has been traditionally executed to rotatably fit a cylindrical portion of the distributor housing, through which a shaft of the rotor is pierced, into a fitting hole formed in a part of the engine, to form an elongated hole in a flange extended laterally from the cylindrical portion, and to rotate the housing about the cylindrical portion as far as the ignition timing may be adjusted, before a bolt pierced through the elongated hole is screwed up so that the housing may be fixed at a best suitable phase.

This determination or adjustment of the ignition timing is executed on full consideration of driving efficiency of the engine as well as diminishing of concentration of the harmful or toxic gas contained in the exhaust gas from the engine, so it requires fairly large scale equipment therefor and high technical skill. It is therefore highly desirable that the once settled position of the distributor will not be changed easily or unexpectedly.

A most suitable ignition timing only from the view point of driving efficiency of the engine is not necessarily equal to or agreeable with a most suitable ignition timing viewed from the driving efficiency of the engine and the diminishing of concentration of the toxic gas in the exhaust gas in parallel. In a case wherein the driving efficiency of the engine can be enhanced at the sacrifice of increasing the concentration of the toxic gas, it can happen that users of cars intentionally change the phase of the distributor. In some countries car makers are therefore said to be restricted or regulated to take a necessary measure by laws not to allow the users to easily change the phase of the distributor.

SUMMARY AND OBJECTS OF THE INVENTION

This invention was made from such a background with a primary object of providing an improved device for preventing the fixed angle of a distributor in which a once fixed angle thereof can not easily be changed.

Another object of this invention is to provide a preventive device for a distributor, against the change of the once fixed angle, being easy in its manufacturing and mounting to a proper place.

The preventive device against change of the fixed angle of the distributor in accordance with this invention includes a fixing block of substantially hexahedron shape provided with a circular hole bored therethrough having an inner diameter slightly larer than the diameter of the earlier said bolt, which will be pierced therethrough when the distributor is fastened at the flange thereof to the engine, in the direction of its thickness and at least one thrusting or intruding projection, with greater hardness than that of the flange, formed on either side surface parallel to the longitudinal direction of the elongated hole. The fixing block is, when the bolt pierced through the circular hole is fastened, intruded at the thrusting projections on either side surface thereof into the two mutually opposite walls of the elongated hole, consequently preventing the flange from being rotated about the axis of the cylindrical portion of the distributor housing.

The distributor fixed in this way is well prevented from being disclocated in relation to the engine in a case of possibly happening slight loosening of the bolt or even in a case of purposeful or intentional hammering of the flange side by a user.

It is only one extra part that this invention specifically requires for the great improvement of the fixing device, that is a fixing block of simple configuration. Since this fixing block is fastened by taking advantage of the fastening force of the bolt which is originally indispensable for fixing the flange of the engine, the object of this invention can be achieved quite inexpensively.

DETAILED DESCRIPTION OF THE PREFERRED EMBODIMENTS

Preferred embodiments of this invention will be described hereunder with reference to the appended drawing, in which:

FIG. 1 is an elevation partly in section of a distributor in which an embodiment of a device for preventing change of the fixed angle of a distributor of this invention is incorporated;

FIGS. 5 to 7 are respectively a plan, an elevation, and a profile of a fixing block employed in another embodiment of this invention;

FIGS. 8 to 10 are respectively a plan, an elevation, and a profile of a fixing block employed in still another embodiment of this invention.

Figure 2:
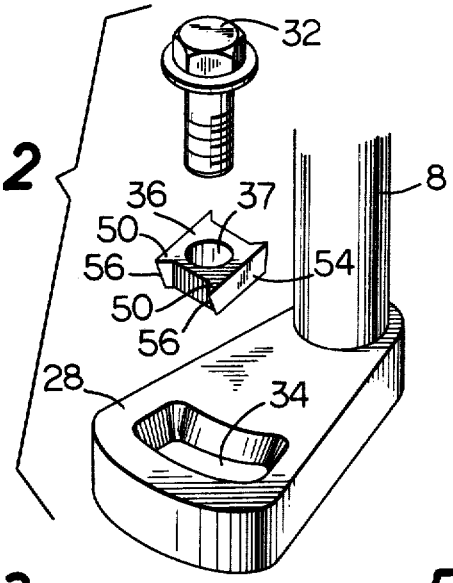
FIG. 2 is an exploded perspective view of an essential part of the apparatus shown in FIG. 1.

A distributor 2 attached to an engine 4 is, as shown in FIG. 1, provided with a housing 6, and in a cylindrical portion 8 of the housing 6 a rotor shaft 10 is rotatably pierced through. The lower end of the rotor shaft 10 is via a not-shown gear connected to a cam-shaft for being able to be synchronously rotated with a crankshaft of the engine.

On the upper end of the rotor shaft 10 a rotor 16 having a timing rotor 12 and a rotor arm pole 14 is secured, while on the housing 6 a generator 18 and a cap 20 are mounted. The generator 18 is provided with a pick-up or a chopper for generating ignition signal in response to rotation of the timing rotor 12, which signal is boosted to a predetermined ignition voltage by an ignition coil or the like so as to be supplied to a central contact 22 disposed at the center of the cap 20. The ignition voltage thus applied is further delivered from the rotor arm pole 14 which rotates in contact with the central contact 22 to a plurality of side poles 24 disposed on the external portion of the cap 20 by spark discharge. The side poles 24 supply the ignition voltae to each ignition plug of the engine 4.

Timing of the ignition signal generation at the distributor 2 is adjusted by means of varying relative phase of the generator 18 to the timing rotor 12 through a relative rotation of the housing 6 against the rotor shaft 10. For that purpose the housing 6 is attached in a rotatable manner about the axis of the rotor shaft 10 to the engine 4. In other words, the external peripheral surface of the cylindrical portion 8 of the housing 6 is concentrically formed with the rotor shaft 10, and the cylindrical portion 8 is rotatably fitted in a circular through-hole formed in the engine 4. A flange 28 formed extending from the cylindrical portion 8 is just seated on a seat surface formed on the engine 4 for being fastened together with a bolt 32.

Figure 3:
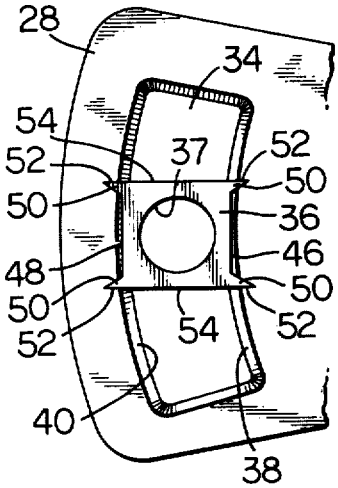
FIG. 3 is a plan view of an essential part of the apparatus shown in FIG. 1, wherein a bolt is being removed for better understanding.

The flange 28 is extended perpendicularly in only one direction from the cylindrical portion 8 and provided in the neighborhood of the end thereof with an elongated hole 34, as can be seen clearly in FIGS. 2 and 3, of arcuate form having its center on the axis of the cylindrical portion 8. In this elongated hole 34 a fixing block 36 is fixed, and the bolt 32 is pierced through a circular hole 37 bored through the fixing block 36 in the direction of the thickness, at the central portion, thereof for fastening up the flange 28 to the engine 4 as shown in FIG. 4.

Figure 4:
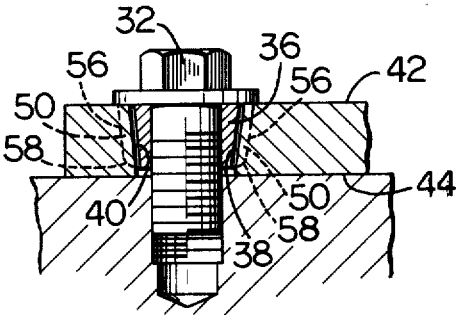
FIG. 4 is an enlargement of an essential part of the apparatus shown in FIG. 1.

The fixing block 36 is of nearly hexahedron shape as a whole, but it is of inverted isosceles trapezoid shape in its section, having a narrower width on the reverse surface than on the obverse surface, because it must be agreeable with the shape of the elongated hole 34 which is gradually diminished in the width, i.e., the distance between the mutually opposite walls 38, 40, from the obverse surface 42 of the flange 28 toward the reverse surface 44 thereof as shown in FIG. 4. The fixing block 36 is provided, on either side surface 46, 48 faced to the walls 46, 48 of the elongated hole 34, with a pair of thrusting or intruding ribs 50 respectively. The thrusting ribs 50 are of triangular shape in section and respectively extending, on either edge of the side surfaces 46, 48, in the direction of the thickness of the fixing block 36, and one side surface 52 of the thrusting rib 50 constitutes a continuation of one side surface 54 of the fixing block 36 not faaced to the wall (38, 40) to be one flat plane together with the latter. This makes the formation of the sharp ridge 56 of the thrusting rib 50 quite simple only by cutting or grinding the side surface 54 of the fixing block 36.

The thrusting ribs 50 are, when the bolt 32 is fastened through the circular hole 37 in the fixing block 36 after the determination of the most suitable fixation angle of the distributor 2 for the ignition timing, thrusted or intruded into the walls 38, 40 of the elongated hole 34 as shown in FIG. 3. While the housing 6 including the flange 28 is made of aluminum, the fixing block 36 is made, for the purpose of easy thrusting, of steel which is far harder than aluminum. The thrusting rib 50 is so made as to be gradually lower toward the thrusting tip 58, as can be seen in FIG. 4. The formation of the fixing block 36 into the inverted trapezoid shape so as to be agreeable with the configuration of the elongated hole 34 wherein the width is gradually larger toward the top brim is for making the initial insertion of the fixing block 36 into the elongated hole 34 easy and smooth and also for making the thrusting or intruding of the thrusting ribs 50 into the walls 38, 40 along the whole length of the ridge lines 56 wasy and smooth.

Once the thrusting rib 50 have been completely intruded into the walls 38, 40 along the whole length thereof the fixing block 36 is firmly fixed to the flange 28. It will have an effect as if the flange itself were provided with the circular hole 37, and the bolt 32 pierced therethrough for being threaded firmly fastens the flange 28 to the engine 4, which makes the fixed position of the flange 28, namely the fixed angle of the distributor 2 very sure so as not to be changed easily. In fact, the fixing block 36 was so firmly settled in place that it could not be moved in the elongated hole 34 in an experiment executed by the inventors and some others on a pilot distributor, wherein the flange 28 was hit by a hammer so violently as to produce a fairly appreciable recess or scar on its side surface. This experiment also provided, as its secondary effect, that the thrusting rib 50 wherein one side thereof was made substantially perpendicular to the longitudinal direction of the elongated hole 34 was higher in its blocking function in the elongated hole 34 in comparison to another embodiment of the thrusting rib wherein both sides thereof were inclined to form an isosceles triangle therebetween, which was also usable, though.

If and when the distributor 2 has to be removed (a) due to misadjustment of the ignition timing in the course of assemblying, (b) for repairing the distributor 2 after actual use thereof, or (c) due to a possible necessity of readjustment of the fixed angle caused by long using, being very rare though, it is possible to change the fixed angle by removing the distributor 2 from the engine 4, by means of descrewing the bolt 32. Then the fixing block 36 can be removed from the flange 28 only by hammering the lower side thereof. Changing of the fixing angle of the distributor 2 by means of removing the distributor 2 by a car user himself is in fact a rare case.

Removing of the distributor 2 for the purpose of checking, repairing, and so on is permissible in this embodiment just like in ordinary ones, and resetting of the same is also quite easy only by fastening the bolt 32 pierced through the circular hole 37. Revival or restoration of the fixing angle of the distributor can be realized with high precision, eliminating troublesome and time-consuming adjustment work of the ignition timing.

Another embodiment of a fixing block 62 illustrated in FIGS. 5–7 will be briefly described hereunder. The fixing block 62 of this embodiment is provided with one more thrusting rib 64 located in the middle on either side surface thereof besides the pair of thrusting ribs 50 in the previous embodiment. This thrusting rib 64 is of isosceles triangular shape in its section, and identical to that in the previous embodiment in its use and function.

While the fixing blocks 36, 62 of the foregoing two embodiments are almost of rectangular in the plan view thereof, and the thrusting ribs 50, 64 are relatively of large height, another type of fixing block 66 illustrated in FIGS. 8–10 is also permissible, wherein either side surface is of arcuate form being agreeable with the arcuate surface of the walls 38, 40 of the elongated hole 34. Either arcuate side surface of the fixing block 66 is provided with a multiplicity of thrusting ribs 68 with a triangular section consecutively formed thereon for effectively functioning intrusion into the walls 38, 40.

Figure 11:
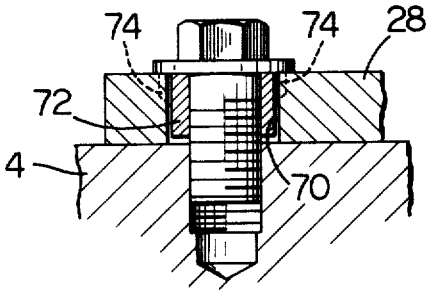
FIG. 11 is a corresponding view to FIG. 4 of an essential part of a further embodiment of this invention.

Still another embodiment will be introduced with reference to FIG. 11, in which an elongated hole 70 formed in the flange 28 of the distributor is constant in the width from top to bottom, and the width of the fixing block 72 is similarly constant. The fixing block 72 is almost of rectangular parallelepiped form, and arrangement and sectional shape of the thrusting ribs 74 are identical to those shown in FIG. 3, the only difference lies in its being small in length and disposition thereof only on the upward portion of the fixing block 72.

As can be understood from the above description the fixing block is required only to be of substantially hexahedron form, and the number and shape of the thrusting ribs are allowed to be variously changed. As to the material of the fixing block, the sphere of selection therefor is wide so long as the hardness of the thrusting projections such as ribs is greater than that of the flange of the distributor. Even when the material of the fixing block is similar to that of the flange, hardening applied partially on the thrusting projections and their neighborhood for increasing the hardness thereof is allowable.

It goes without saying that various modifications and alterations are allowed so long as they are within the spirit and scope of the invention.

What is claimed is:

1. A device for preventing a fixed angle change of a distributor in relation to an engine, which distributor includes a cylindrical portion, through which a rotor shaft is pierced, and a flange formed on the cylindrical portion, the cylindrical portion being rotatably fitted into a fitting hole formed in the engine while the flange being firmly seated on the engine by means of a bolt pierced through an arcuate elongated hole formed in the flange, said device comprising a fixing block of substantially hexahedron shape provided with a circular hole bored therethrough in the direction of thickness thereof with an inner diameter slightly larger than the diameter of said bolt and at least one thrusting projection of greater hardness than that of said flange on either side surface of said fixing block parallel to the longitudinal direction of said elongated hole, whereby said fixing block is pierced by said bolt through said circular hole for letting said thrusting ribs intrude, as the bolt is fastened, into two mutually opposed walls of said elongated hole so as to consequently prevent said flange from being rotated about the axis of said cylindrical portion.

2. A device in accordance with claim 1, wherein said fixing block is provided with a thrusting projection on both edges of said either side surface respectively, four in all.

3. A device in accordance with claim 1, wherein said thrusting projections are thrusting ribs longitudinally formed in the direction of thickness of said fixing block, with a sectional configuration of substantially triangle.

4. A device in accordance with claim 3, wherein said ffixing block is provided with said thrusting rib one on both edges of said either side surface respectively, four in all, and one side surface said thrusting ribs constitutes a continuation of a side surface of said fixing block substantially perpendicular to the longitudinal direction of said elongated hole to be one flat plane.

5. A device in accordance with claim 3, wherein said fixing block is provided with said thrusting rib respectively one on both edges and one in the middle of said either side surface, six in all.

6. A device in accordance with claim 3, wherein a multiplicity of said thrusting ribs are consecutively disposed on said either side surface of said fixing block.

7. A device in accordance with claim 1, wherein the width of said elongated hole is made gradually smaller from the obverse side toward the reverse side and the shape of said fixing block is made correspondingly agreeable with the shape of said elongated hole for being inserted therein.

8. A device in accordance with claim 3, wherein the height of said thrusting rib is made gradually lower toward the tip thereof for the purpose of facilitating the intrusion into the flange.

9. A device in accordance with claim 3, wherein said thrusting rib is formed so as to extend along the whole length of said fixing block in the direction of the thickness thereof.

10. A device in accordance with claim 3, wherein said thrusting rib is formed only on the portion of said fixing block nearer to the top surface thereof.

* * * * *